US005880432A

United States Patent [19]

Radmacher

[11] Patent Number: 5,880,432

[45] Date of Patent: Mar. 9, 1999

[54] ELECTRIC HEATING DEVICE WITH CERAMIC HEATER WEDGINGLY RECEIVED WITHIN A METALIC BODY

[75] Inventor: Stephen J. Radmacher, Toronto, Canada

[73] Assignee: Le-Mark International Ltd., Kowloon, Hong Kong

[21] Appl. No.: 772,656

[22] Filed: Dec. 23, 1996

[51] Int. Cl.[6] ..... F23Q 7/00

[52] U.S. Cl. ..... 219/270; 123/145 A; 219/546; 219/536; 219/544

[58] Field of Search ..... 219/270, 267, 219/544, 546, 536; 123/145 A; 361/264–266; 338/232, 233, 315

[56] References Cited

U.S. PATENT DOCUMENTS

| | | | |
|---|---|---|---|
| 1,927,562 | 9/1933 | Dorner et al. | 219/270 |
| 1,950,457 | 3/1934 | Payne et al. | 132/145 A |
| 2,127,983 | 8/1938 | Nowosielski | 123/145 A |
| 4,475,029 | 10/1984 | Yoshida et al. | 219/270 |
| 4,806,734 | 2/1989 | Masaka et al. . | |
| 5,075,536 | 12/1991 | Towe et al. | 219/270 |
| 5,084,607 | 1/1992 | Shafer et al. | 219/270 |
| 5,589,091 | 12/1996 | Muller | 219/270 |

FOREIGN PATENT DOCUMENTS

| | | | |
|---|---|---|---|
| 648977 | 4/1995 | European Pat. Off. . | |
| 1297785 | 6/1969 | Germany | 219/544 |
| 88 15 005 | 3/1990 | Germany . | |
| 2 092 670 | 8/1982 | United Kingdom . | |

*Primary Examiner*—John A. Jeffery
*Attorney, Agent, or Firm*—Gowling, Strathy & Henderson

[57] ABSTRACT

A cermanic heating device, such as a glow plug for use in a diesel engine, has a metallic body with a central bore, a creamic heater portion having a tapered body and a conductive core, and a conductor for electrically connecting the core. The central bore wedgingly receives the ceramic heater portion within the central bore securing electrical contact with the metallic body and positions a distal tip of the ceramic heater portion longitudinally from the metallic body.

14 Claims, 2 Drawing Sheets

ELECTRIC HEATING DEVICE WITH CERAMIC HEATER WEDGINGLY RECEIVED WITHIN A METALIC BODY

FIELD OF INVENTION

This invention relates to a ceramic heater device. In particular, this invention relates to a novel tapered design for a ceramic tip of a ceramic heater device used as a glow plug for a diesel engine.

BACKGROUND OF THE INVENTION

Ceramic heater devices are well known in the art. The ceramic heater tip of a glow plug is generally a cylindrical element which is brazed to a metallic body or housing. However, the brazing is susceptible to failure due to the high combustion chamber pressures and temperature.

Further, such cylindrical ceramic heater tips become caked with a carbon coating during normal use. If service is required for the glow plug, the glow plug must be extracted from the cylinder head. The carbon build-up on the ceramic tip tends to lock the ceramic tip in the cylinder head. As the repairer removes the metallic body, the ceramic tip occasionally becomes dislodged from the metallic body and remains in the cylinder head, which is highly undesirable.

Attempts have been made to address this problem by improving the mechanical joint structure for positively retaining the ceramic heating tip within the bore of the body of the glow plug, as disclosed in U.S. Pat. No. 5,084,607. However, this proposed design requires additional precision parts to be manufactured, and thus increases the cost of the glow plug.

SUMMARY OF THE INVENTION

The disadvantages of the prior art may be overcome by providing a ceramic heating device having a tapered ceramic heating tip wedgingly engaging a bore of a body of a glow plug.

According to one aspect of the invention, there is provided a ceramic heating device comprising a metallic body having a central bore and means for securing the metallic body to a cylinder head of an engine, a ceramic heater portion having a tapered body, conduction means for electrically connecting a core of the ceramic heater portion, and fitting means for frictionally securing the ceramic heater portion within the central bore in electrical contact with the metallic body and positioning a distal tip of the ceramic heater portion longitudinally from the metallic body.

According to another aspect of the invention, there is provided a ceramic heating device comprising a metallic body having a central bore and means for securing the metallic body to a cylinder head of an engine, a ceramic heater portion having a tapered body, a conductor for electrically connecting a core of the ceramic heater portion, an annular ring fitted within the central bore for frictionally securing the ceramic heater portion within the central bore in electrical contact with the metallic body and positioning a distal tip of the ceramic heater portion longitudinally from the metallic body. The conductor extends through the bore in electrically contact with a core of the ceramic heater portion. An insulator cap closes the bore and the conductor extends through the cap. The annular ring has an inner bore having a taper complementary to the taper of the ceramic heater portion. The annular ring abuts a flange at a distal end of the central bore. The central bore is filled with epoxy to secure the ceramic heater portion in the distal end of the metallic body.

According to another aspect of the invention, there is provided a ceramic heater for a glow plug comprising a metallic body having a central bore, a conductor electrically connected to the ceramic heater and insulated from the metallic body. The ceramic heater has a tapered body for frictionally engaging within the central bore in electrical contact with the metallic body.

According to another aspect of the invention, there is provided a glow plug having an annular ring fitted within a central bore. The annular ring has an inner bore having a taper complementary to the tapered body of the ceramic heater portion.

According to another aspect of the invention, there is provided a glow plug having a tapered annular bore. The taper is complementary to the tapered body of the ceramic heater portion.

DESCRIPTION OF THE DRAWINGS

In drawings which illustrate embodiments of the invention

DESCRIPTION OF THE INVENTION

Figure 1:
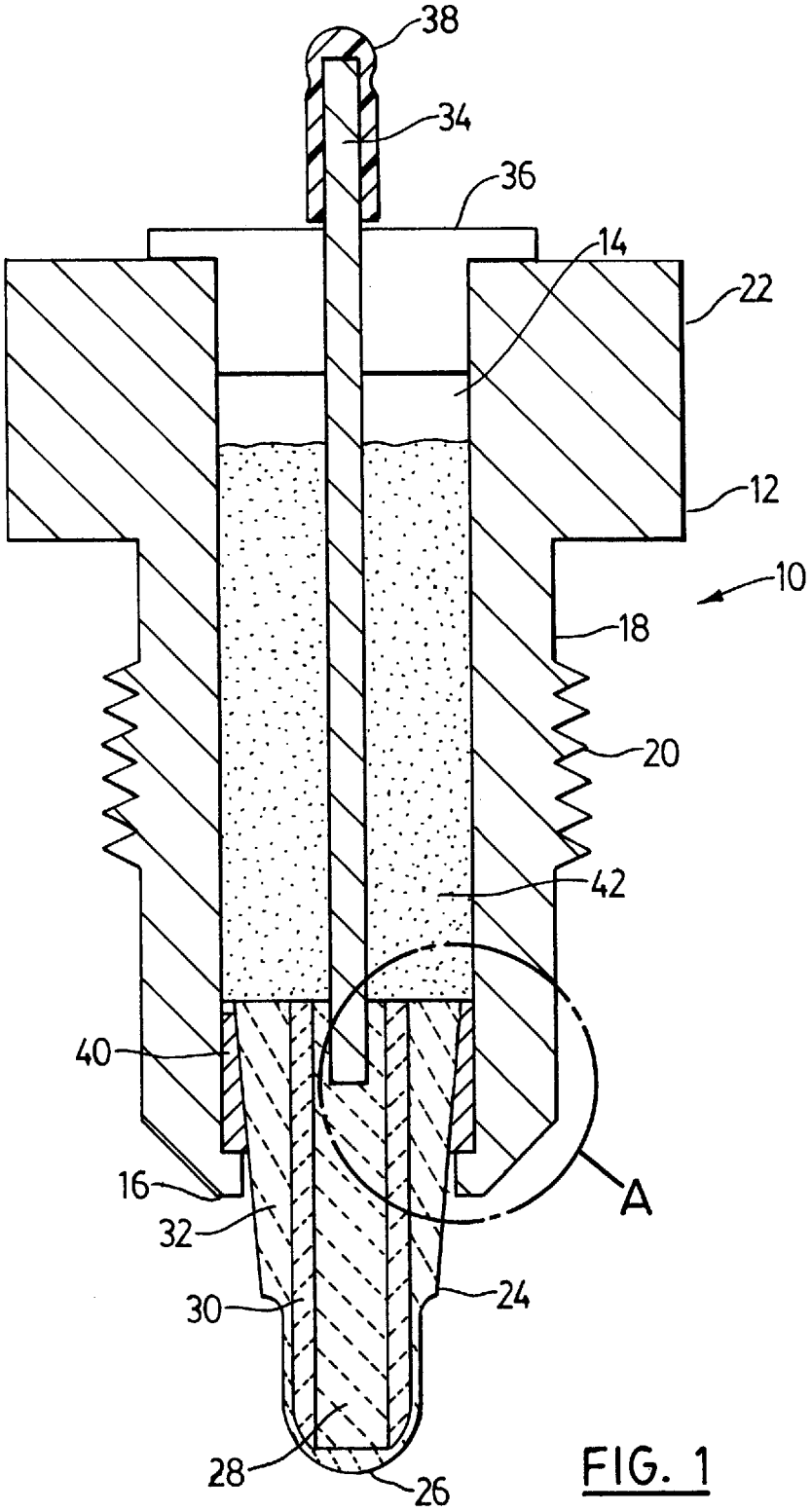
FIG. 1 is a side sectional view of the ceramic heating device of the present invention.
Figure 2:
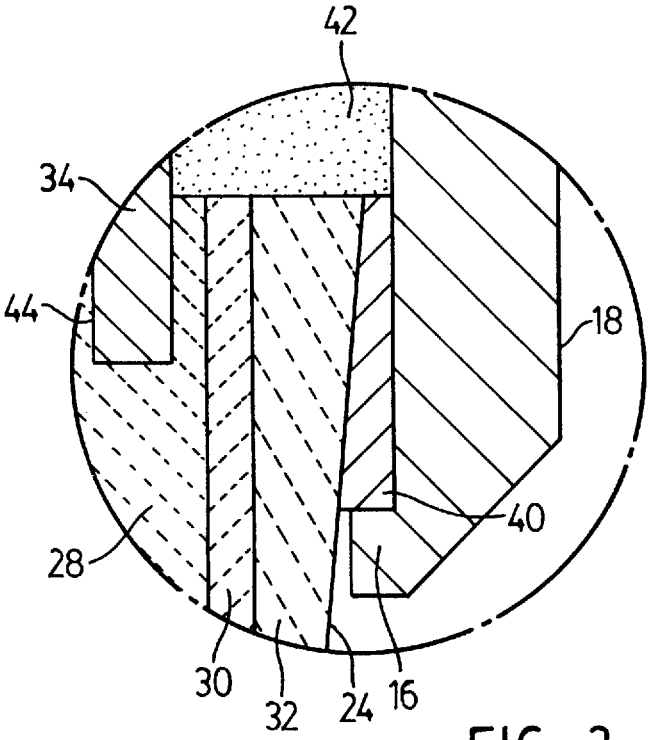
FIG. 2 is a detailed sectional view of the interconnection between a tapered ceramic tip and an inner bore of a metallic body of the ceramic heating device of the embodiment of FIG. 1.

The ceramic heating device of the present invention is generally illustrated in FIG. 1 as glow plug 10. Glow plug 10 includes a rigid metallic body 12 having a central longitudinal bore 14 extending therethrough. A circumferentially extending lip or flange 16 extends into bore 14 at the distal end of barrel 18. Barrel 18 has an external thread 20 for threadably engaging or securing the glow plug 10 in an internal threaded bore of the cylinder head of a diesel engine (not shown). Body 12 also has a head 22 having a hex nut configuration for mechanically rotating the body 12.

The ceramic heater portion 24 has a generally tapered body. The distal end 26 of ceramic heater portion 24 is of a conventional design well known in the art (see for example U.S. Pat. Nos. 5,519,187, 4,742,095. Generally, the ceramic heater portion 24 comprises three layers comprising a ceramic rod core 28, an annular ceramic tubular member 30 and a ceramic outer tube 32 sintered to the tubular member 30.

A conduction means, shown as conductor wire 34 extends centrally through the bore 14 and is insulated from the metallic body 12. Non-metallic insulator cap 36 is fitted in a near end of bore 14. A connector cap 38 is fitted on the exposed end of conductive wire 34. Conductor wire 34 extends through the insulator cap 36 to the ceramic rod core 28 of ceramic heater portion 24.

The near end of ceramic heater portion 24 abuts with a fitting means, shown as conductive annular sleeve 40, so that the distal tip 26 extends longitudinally from the metallic body 12 a predetermined distance. As used herein, conductive is defined to mean electrically conductive. The inner bore surface of sleeve 40 is tapered to complementarily fit with the taper of ceramic heater portion 24. The cavity in bore 14 between non-metallic insulator cap 36 and the near end of ceramic heater portion 24 is filled with an epoxy resin filler 42.

To assemble, conductive sleeve 40 is concentrically inserted into bore 14 to abut with lip 16 at the distal end of barrel 18. Ceramic heater portion 24 is then inserted into bore 14 to become frictionally engaged within conductive annular sleeve 40 in a wedged manner, thereby permitting ceramic heater portion 24 to electrically contact body 12. The distal end of conductive wire 34 is firmly fitted within and in electrical contact with an end bore 44 of ceramic rod core 28 of ceramic heater portion 24. The bore 14 is filled with epoxy resin filler 42 for curing therein. Epoxy 42 secures ceramic heater portion 24 in frictional engagement and electrical contact with metallic body 12. Non-metallic insulator cap 36 is fitted over the end of conductive wire 34 to support the conductive wire 34, while epoxy resin filler 42 cures. Connector cap 38 is then placed over the near end of conductive wire 34.

The ceramic heater device of the present invention is ready to be used in a conventional manner in replacement of any existing glow plug. It is readily understood that the size of the glow plug 10 is dictated by the specific diesel engine in which the glow plug 10 is to be used.

On removing the glow plug 10 from the cylinder head, it is apparent that the positive wedge fitting between the ceramic heater portion 24 and conductive annular sleeve 40 will provide a positive wedge force to the ceramic heater portion 24 to remove same as the body 12 is being urged out of cylinder head. The positive wedge force prevents the ceramic heater portion 24 from coming out of the body 12 and remaining in the cylinder head.

Figure 3:
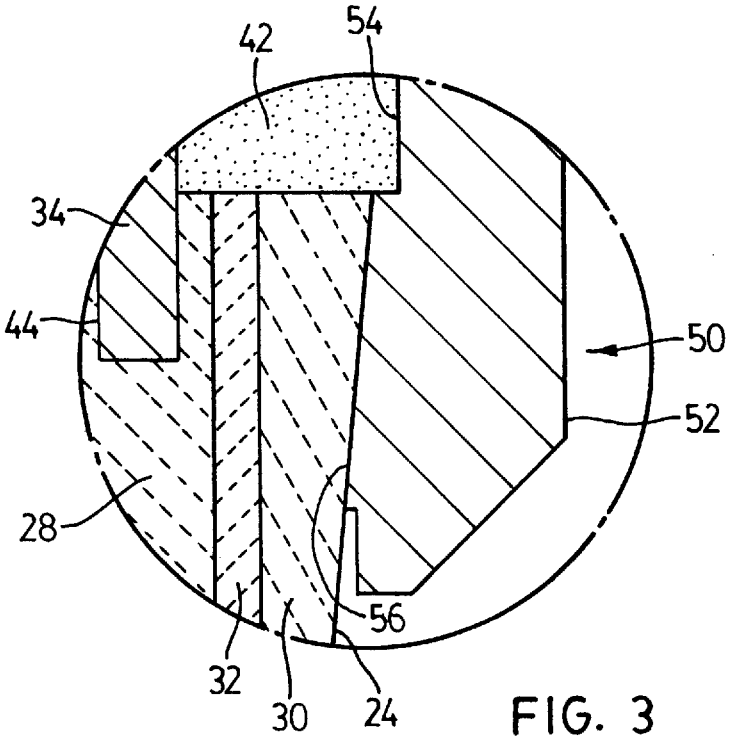
FIG. 3 is a detailed sectional view of the interconnection between the tapered ceramic tip and an inner bore of a metallic body of the ceramic heating device of a second embodiment.

Referring to FIG. 3, a second embodiment of the present invention is illustrated. Metallic body 50 has a barrel 52 having a central bore 54. The distal end of the bore 54 has a fitting means, shown as an inner circumferential tapered surface 56 which is complementary to the taper of the ceramic heater portion 24. Ceramic heater portion 24 will frictionally engage tapered surface 56 in a wedged manner. Tapered surface 56 is positioned along the bore 54 such that the distal tip 26 of the ceramic heater portion extends longitudinally from the metallic body 50 a predetermined distance.

Although a preferred embodiment has been described in detail above, those of ordinary skill in the art will recognize that modifications are possible without departing from the teachings of the present invention. All such modifications are intended to be encompassed herein.

I claim:

1. A ceramic healing device comprising:

a metallic body having a central bore and means for securing said metallic body to a cylinder head of an engine, a ceramic heater having a tapered body portion tapering to a heater tip portion said ceramic heater having a resistive outer ceramic layer, an insultative intermediate ceramic layer and a conductive inner ceramic core in electrical communication with said outer layer;

conduction means extending through said central bore said inner core conduction mean insulated from said metallic housing and electrically connected to said inner core and an inner circumferential tapered surface in said bore said inner circumferential tapered surface having a taper complementary to the taper of said tapered body portion for frictionally securing said tapered body portion within said central bore at a distal end of said metallic body, said outer layer in electrical contact with said inner circumferential tapered surface and said heater tip portion positioned longitudinally from metallic body.

2. A ceramic heating device as claimed in claim 1 wherein said inner circumferential tapered surface is an inner surface of a conductive annular sleeve fitted within said central bore and electrically contracting said metallic body.

3. A ceramic heater device as claimed in claim 2 wherein said conductive annular sleeve abuts a flange said distal end for retaining said sleeve within said bore.

4. A ceramic heating device as claimed in claim 1 wherein said central bore is filled with epoxy to secure said outer layer in electrical contact with said inner circumferential tapered surface.

5. A ceramic heating device as claimed in claim 1 wherein said conduction means is a conductive wire, a distal portion of which is in electrical contact with said inner core.

6. A ceramic heating device as claimed in claim 5 wherein said bore has an insulator cap for sealing a proximal end of said bore, said conductive wire extending through said cap.

7. A ceramic heating device as claimed in claim 6 wherein said inner circumferential tapered surface comprises a conductive annular sleeve fitted within said central bore and electrically contacting said metallic body.

8. A ceramic heating device as claimed in claim 7 wherein said conductive annular sleeve abuts a flange at said distal end for retaining said sleeve within aid bore.

9. A ceramic heating device as claimed in claim 8 wherein said central bore is filled with epoxy to secure said tapered body portion m said frictional fit.

10. A glow plug for an engine comprising a metallic body having a central bore, a conductor electrically connected to a ceramic heater and insulated from said metallic body, said ceramic heater having a resistive outer ceramic layer an insulative intermediate ceramic layer and a conductive inner ceramic core in electrical communication with said outer layer, said ceramic heater having a tapered body portion tapering to a heater tip portion, said outer layer of said tapered body portion frictionally engaging and electrically contacting an inner circumferential tapered surface of said central bore having a taper complementary to the taper of said tapered body portion.

11. A glow plug for an engine as claimed in claim 10 wherein said inner circumferential tapered surface is an inner surface of a conductive annular sleeve fitted within said central bore and electrically contracting said metallic body.

12. A glow plug for an engine as claimed in claim 11 wherein said conductive annular sleeve abuts a flange extending into said central bore and positions said heater tip portion longitudinally from said distal end.

13. A glow plug for an engine as claimed in claim 10 wherein said central bore is filled with epoxy to secure said ceramic heater portion in said frictional engagement.

14. A glow plug for an engine as claimed in claim 10 wherein said bore has an insulator cap for sealing a proximal end bore, said conductor extending through said cap.

* * * * *